US009174779B2

(12) United States Patent
Boeckeler

(10) Patent No.: US 9,174,779 B2
(45) Date of Patent: Nov. 3, 2015

(54) VIAL CAP 187

(75) Inventor: Matthew Boeckeler, Waltham, MA (US)

(73) Assignee: ASTRAZENECA AB (SE)

( * ) Notice: Subject to any disclaimer, the term of this patent is extended or adjusted under 35 U.S.C. 154(b) by 1239 days.

(21) Appl. No.: 12/747,038

(22) PCT Filed: Dec. 9, 2008

(86) PCT No.: PCT/SE2008/051425

§ 371 (c)(1),
(2), (4) Date: Sep. 13, 2010

(87) PCT Pub. No.: WO2009/075637

PCT Pub. Date: Jun. 18, 2009

(65) Prior Publication Data

US 2011/0005622 A1 Jan. 13, 2011

Related U.S. Application Data

(60) Provisional application No. 61/012,541, filed on Dec. 10, 2007.

(51) Int. Cl.
*B01L 99/00* (2010.01)
*B65D 51/00* (2006.01)
(Continued)

(52) U.S. Cl.
CPC ..... *B65D 51/002* (2013.01); *A61J 1/1406* (2013.01); *B01L 3/50825* (2013.01);
(Continued)

(58) Field of Classification Search
CPC ..... B65D 41/20; B65D 47/36; B65D 51/00; B65D 51/002; B01L 3/00; B01L 3/02; B01L 3/508; B01L 3/50825; B01L 3/523; B01L 2300/04; B01L 2300/041; B01L 2300/044; A61J 1/14; A61J 1/1406
USPC ..... 422/501, 509, 512, 547, 568, 570
See application file for complete search history.

(56) References Cited

U.S. PATENT DOCUMENTS 2,969,161 A 1/1961 McCulloch
3,592,351 A 7/1971 Johnson, Jr. et al.
(Continued)

FOREIGN PATENT DOCUMENTS

DE 10114423 A1 10/2002
FR 2675779 A3 10/1992
(Continued)

OTHER PUBLICATIONS

International Search Report, mailed on Mar. 3, 2009, in Application No. PCT/SE2008/051425.
(Continued)

*Primary Examiner* — Jill Warden
*Assistant Examiner* — Dwayne K Handy
(74) *Attorney, Agent, or Firm* — Finnegan, Henderson, Farabow, Garrett & Dunner, LLP

(57) ABSTRACT

An elastomeric vial cap used for sealing a vial container, but allowing pipette access to its containment fluid includes an annular flange portion for capping the vial and a sloped truncated cone portion to easily guide the pipette into the vial container. A tubular seal portion is configured to encircle the truncated cone portion and firmly engage an inside wall of the vial container with ease of insertion. A center flap portion is circumscribed by a channel at its top surface for penetration by the pipette and has a flex portion. The center flap portion separates around the perimeter of the channel but hinges at the channel above the flex portion and does not become dislodged. The ratio of the diameters of the pipette and the center flap portion is such that significant problems related to back-pressure and vacuum conditions do not exist during transfer of the containment fluid.

16 Claims, 7 Drawing Sheets

(51) Int. Cl.

| | |
|---|---|
| ***A61J 1/14*** | (2006.01) |
| ***B01L 3/00*** | (2006.01) |
| ***B65D 39/00*** | (2006.01) |

(52) U.S. Cl.

CPC ..... *B65D 39/0023* (2013.01); *B01L 2200/026* (2013.01); *B01L 2300/042* (2013.01); *B01L 2300/043* (2013.01); *B01L 2300/044* (2013.01); *B01L 2400/0683* (2013.01); *B65D 2231/022* (2013.01); *Y10T 137/86276* (2013.01)

(56) References Cited

U.S. PATENT DOCUMENTS

| | | | | |
|---|---|---|---|---|
| 3,653,528 | A | 4/1972 | Wimmer | |
| 6,881,380 | B1 * | 4/2005 | Mootz et al. | 422/65 |
| 2001/0041336 | A1 * | 11/2001 | Anderson et al. | 435/6 |
| 2003/0052074 | A1 | 3/2003 | Chang et al. | |

FOREIGN PATENT DOCUMENTS

| | | | |
|---|---|---|---|
| FR | 2 805 524 | A1 | 8/2001 |
| GB | 1074165 | A | 6/1967 |
| JP | 46-9518 | Y | 4/1971 |
| JP | 62-146756 | U | 9/1987 |
| JP | 2-10270 | U | 1/1990 |

OTHER PUBLICATIONS

PCT Written Opinion of the International Searching Authority, mailed on Jun. 3, 2009, in Application No. PCT/SE2008/051425.

PCT International Preliminary Report on Patentability, mailed on Jun. 15, 2010, in Application No. PCT/SE2008/051425.

Notification of Reason(s) for Refusal, dispatched Jan. 8, 2013, in corresponding Japanese Patent Application No. 2010-537896, by AstraZeneca, with English translation (4 pages total).

Supplementary European Search Report issued Feb. 16, 2011, in corresponding European Patent Application No. 08859396.7, by AstraZeneca AB (3 pages).

* cited by examiner

VIAL CAP 187

This is a U.S. National Phase application of PCT/SE2008/051425, filed Dec. 9, 2008, which claims the benefit of priority to U.S. Provisional Application No. 61/012,541, filed Dec. 10, 2007, both of which are incorporated herein by reference in their entireties.

BACKGROUND OF THE INVENTION

This invention relates to a cap for use with a fluid container. In particular, this invention relates to a cap that encloses a vial container of various volumes and shapes. The vial cap allows for penetration by pipette or sampling tube while avoiding the problems associated with the conventional vial cap discussed below.

A problem common to conventional vial caps is the propensity for the pipette or sampling tube to cause a back-pressure during filling or a vacuum condition during aspiration of the vial container. Back-pressure and vacuum conditions can cause errors in the precise transfer of fluid to or from the vial container. For example, a vacuum condition created in the vial container during a pipetting operation may cause the amount of fluid removed from the container to be less than the desired amount. Thus, problems transferring the precise amount of fluid from the vial container to the pipette or vice versa may occur when the pipette engages the vial cap and begins to add or withdraw containment fluid from the vial container.

Another problem with conventional vial caps is lack of symmetry and flange portions that overhang the vial container. Robotic manipulating arms are designed to grasp vial containers of a particular diameter or width. When conventional vial caps are utilized with vial containers, they oftentimes have flanges or other extremities that extend beyond the outer perimeter of the vial container and may cause the robotic manipulating arm to fail to grasp the vial container properly. These conventional vial caps may cause a transport or pipetting operation to completely fail.

Another problem of the conventional vial cap is that it may be damaged during a pipetting operation because the vial cap often has a shallow slope leading to a center flap portion of the vial cap. The shallow slope may cause the pipette to impinge on an area of the vial cap that is not penetrable rather than reaching the center flap portion.

Another problem may occur when the pipette penetrates the center flap portion. The center flap portion may tear-away and fall into the containment fluid causing pipetting and/or contamination problems.

What is needed is a vial cap that works well with robotic manipulating arms, maintains its operability during pipetting operations, keeps its center flap portion from falling into the containment fluid, and can facilitate the transfer of containment fluid without creating back-pressure or vacuum conditions that interfere with the proper pipetting of the containment fluid.

SUMMARY OF THE INVENTION

The present invention describes a vial cap designed to enclose a vial container with fluid.

An aspect of the present invention is to provide a vial cap engaged with a vial container that work well with robotic manipulating arms and pipetting equipment.

Another aspect of the present invention is to provide an appropriately tapered outer conical wall for the vial cap that eases insertion of a pipette into the vial container while maintaining its operability during insertion of the pipette.

Another aspect of the present invention is to eliminate the back-pressure and vacuum issues that arise during filling and removal of fluid from the vial container.

Another aspect of the present invention is to provide a penetrable vial cap that keeps its center flap portion from falling into the containment fluid.

Briefly, a vial cap may be manufactured of elastomeric material for sealing a vial container. Advantageously, the elastomeric material may include polypropylene, polystyrene, polyamide, polyethylene, Alathon M5040™, or any other suitable polymers. The vial cap may be cylindrical in shape and symmetric about a centerline coincident with its cylindrical axis. A top surface of the vial cap may have an annular flange that extends to an outer periphery of the vial cap. The flange may cover the vial container, but may not extend so far as to interfere with robotic manipulating arms.

The vial cap may be designed to allow pipette access to containment fluid in the vial container after penetration of the vial cap by the pipette. A sloped truncated cone may be designed to easily guide the pipette into the vial container without destruction of the vial cap. The slope extends from the top surface of the flange towards the top surface of a center flap portion at an angle between about 40° to 60° with the top surface of the flange.

The center flap portion may be circumscribed by a channel that is designed to tear-away from the truncated cone. The channel may be circular, elliptical, or polygonal at its perimeter. A cross-section of the channel may be u-shaped, v-shaped, or any other shape that facilitates tearing away from the truncated cone. The channel acts like a hinge at a flex portion because the thickness of elastomeric material below the channel at the flex portion is greater than the thickness of elastomeric material below the remaining perimeter of the channel. Thus, the channel above the flex portion allows the center flap portion to bend out of the way, but not to become dislodged and fall into the containment fluid when the pipette penetrates the center flap portion and tears the remaining channel away from the truncated cone. The ratio of the diameters of the penetrating pipette and the center flap portion may be designed so that back-pressure and vacuum conditions during transfer of the containment fluid may be prevented.

A tubular seal that encircles the truncated cone may be designed to insert easily into the vial container and engage the inside walls of the vial container by an outer surface. The tubular seal may be cylindrically shaped having an outer diameter surface including a tapered portion, a band portion, and a cylindrical portion. The tapered portion allows for smooth insertion of the vial cap into the vial container, the band portion allows the vial cap to be engaged with the inside wall surfaces of the vial container, and cylindrical portion allows a snug fit between the end of the vial container and the vial cap. The band portion of the vial cap further includes an insertion segment, a flat segment, and an exit segment that advantageously allows the vial cap to be engaged with the vial container. Multiple band portions also may be provided along an extended outer surface of the tubular seal.

BRIEF DESCRIPTIONS OF THE DRAWINGS

The accompanying drawings, which are incorporated herein and constitute part of this specification, illustrate embodiments of the invention, and, together with the general description given above and the detailed description given below, serve to explain various features of the invention:

Figure 1:
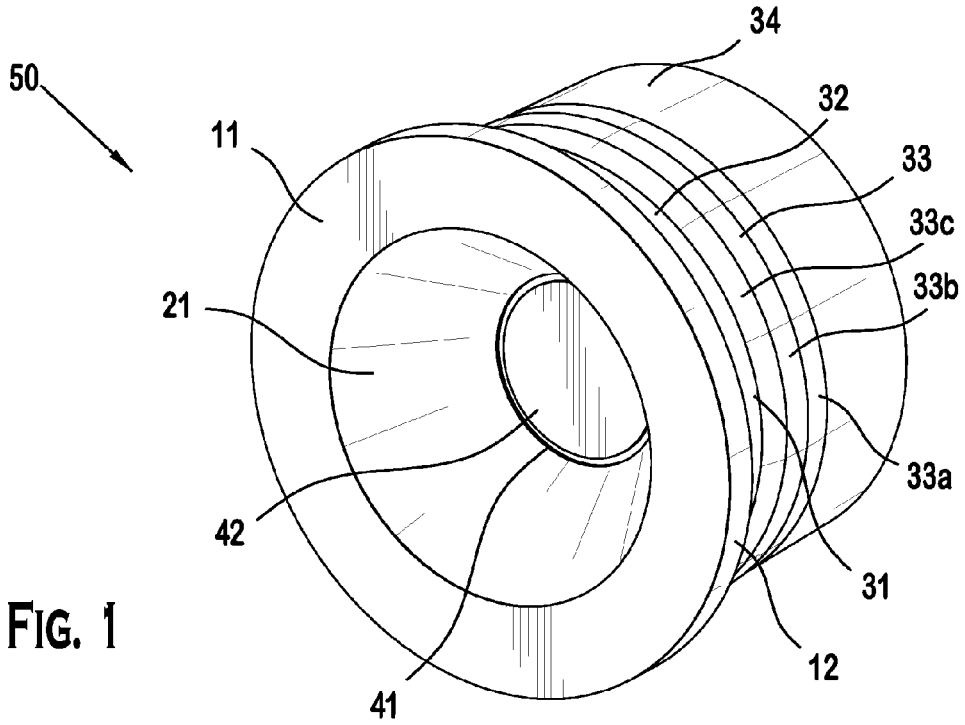
FIG. 1 is a top perspective view of an exemplary vial cap made in accordance with principles of the invention.

The above have been offered for illustrative purposes only, and are not intended to limit the scope of the invention of this application, which is described more fully in the drawings and claims sections set forth below.

DETAILED DESCRIPTION OF PREFERRED EMBODIMENTS

The inventor has found conventional vial caps to suffer from problems including vacuum lock and back-pressure during transfer of the containment fluid and, contamination of the containment fluid by pieces of the vial cap. The present invention integrates features that can improve the performance and utility of the vial cap to overcome deficiencies of current designs and provide general improvements in the art.

Figure 1A:
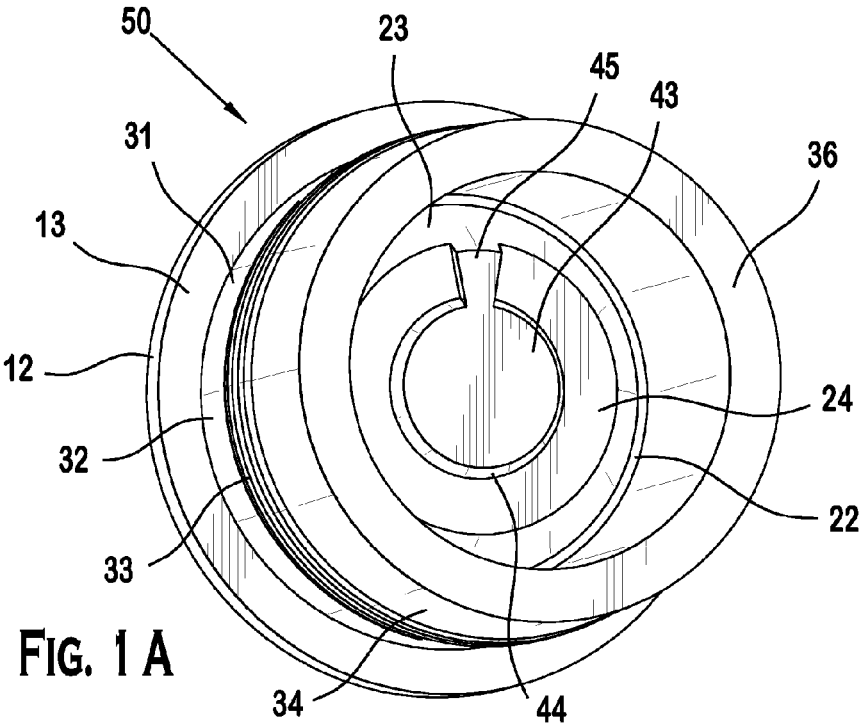
FIG. 1A is a bottom perspective view of the vial cap.

The vial cap can be various sizes depending on the size of vial container and pipette selected. Dimensions are provided as examples herein and it should be understood that variations are possible. FIGS. 1-5E illustrate an embodiment of a vial cap 50. FIG. 1 shows a top perspective view of vial cap 50. The vial cap includes an annular top surface 11 that meets a sloping outer conical wall surface 21 and narrows to meet a channel 41 that circumscribes a top surface 42 at its center. See also FIG. 2 for a top view of these features. In FIG. 1A, a bottom perspective view shows an outer surface 31 that extends perpendicularly from a bottom surface 13 of a flange. FIG. 2A is a bottom view of the features shown in FIG. 1A. A unifying view of the interrelationship of the above mentioned features can be seen in FIG. 3, which is a cross-sectional view of FIG. 2. FIG. 3 displays features of the vial cap 50 including the features of the flange 10, a truncated cone 20, a tubular seal 30, and a center flap portion 40.

As shown in FIG. 3, the flange 10 is annular and disposed at the periphery of the vial cap 50. The bottom surface 13 of the flange may extend out from a cylindrical portion 32 of the outer surface of the tubular seal 30. The flange 10 may extend over the thickness of a vial container's wall and act like a cover. The symmetry and extension of the flange 10 over the vial container's wall reduces the possibility of interference with robotic manipulating arms. Robotic manipulating arms are designed to grasp vial containers of a particular diameter or width. Vial caps that do not have flanges or other extremities that extend beyond the outer perimeter of the vial container improve the robotic manipulating arm's ability to grasp the vial container.

The flange 10 is connected to the truncated cone 20 and tubular seal 30. The tubular seal 30 may be cylindrical in shape and may extend from the bottom surface 13 of the flange 10 and an inner conical base 22 toward a bottom surface 36 of the tubular seal, for example, as shown in FIG. 3. While an inner surface 35 of the tubular seal may be cylindrical and perpendicular to the top surface 11 of the flange, the outer surface 31 of the tubular seal changes slope at different points along its length. A tapered portion 34 of the outer surface of the tubular seal may begin, for example, at the bottom surface 36 and may taper up in a direction away from the centerline of the vial cap for ease of insertion into the vial container. The tapered portion 34 allows for smooth insertion of the vial cap into the vial container.

The outer surface 31 may change slope again when a band portion 33 of the outer surface of the tubular seal is encountered. In FIG. 3, the band portion 33 is wider than the outer diameter of the tapered portion 34 at the bottom surface 36. An insert slope segment 33*a* of the band portion 33 may increase in slope over the tapered portion 34, and then decrease in slope until the band portion 33 enters a flat segment 33*b* where the slope is substantially parallel to the cylindrical portion 32 of the outer surface of the tubular seal. The band portion 33 then enters an exit slope segment 33*c* where the exit slope segment decreases in slope and terminates at the cylindrical portion 32 of the outer surface of the tubular seal, for example, as shown in FIG. 3.

Figure 6:
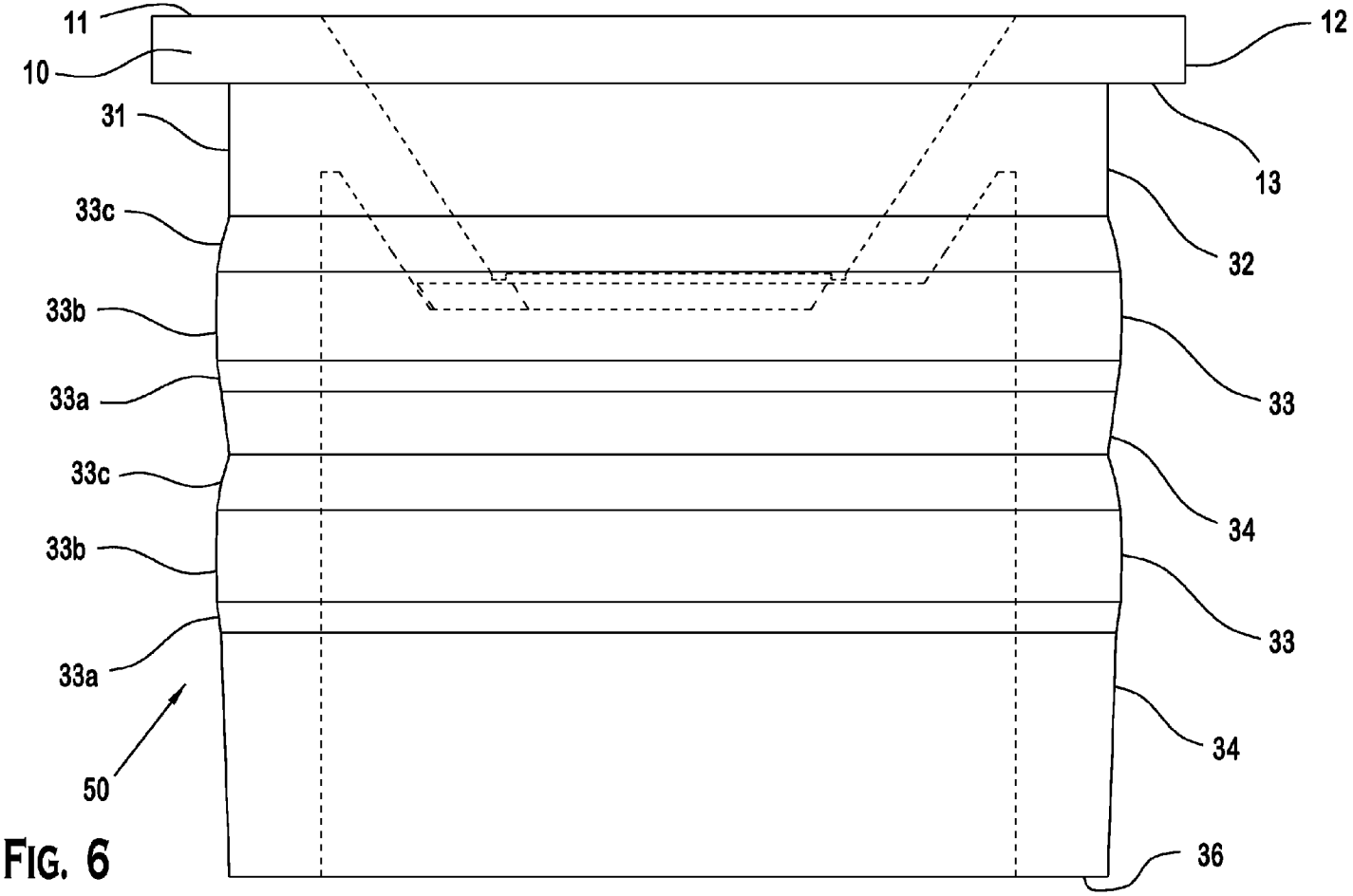
FIG. 6 is a side elevation view of another embodiment of the vial cap.

In another embodiment of the present invention, multiple band portions 33 are provided along an extended outer surface 31 of the tubular seal 30, for example, as shown in FIG. 6. The extended length of the outer surface 31 of the tubular seal 30 may be necessary in order to fit the additional band portions along its length. Multiple band portions 33 may provide added engagement between the vial cap 50 and the vial container.

The cylindrical portion 32 of the outer surface 31 of the tubular seal 30 runs parallel to the inner surface 35 of the tubular seal and may have the same diameter as the beginning outer diameter of the tapered portion 34, for example, as shown in FIG. 3. The cylindrical portion 32 may be perpendicular to the bottom surface 13 of the flange 10 and ends there. The cylindrical portion 32 allows a snug fit between a mouth of the vial container and the vial cap 50.

The truncated cone 20 extends from the top surface 11 of the flange 10 and the tubular seal 30 down towards the center flap portion 40 of the vial cap 50. The slope of the outer conical wall surface 21 of the truncated cone 20 may guide the pipette or sampling tube toward the center flap portion 40. The slope of the outer conical wall surface 21 may extend from the top surface 11 of the flange 10 towards the top surface 42 of the center flap portion at an angle between about 40° to 60° with the top surface 11 of the flange 10. An inner conical wall surface 23 runs substantially parallel to the outer conical wall surface 21, and may begin at the inner conical base 22 and may end at an inner conical plateau 24, for example, as shown in FIG. 3 and FIG. 1A.

The center flap portion 40 may include the channel 41 and a flex portion 45. The flex portion 45 may be an extension of the inner conical wall surface 23 to a bottom surface 43 of the center flap portion 40, for example, as shown in FIG. 3. The bottom surface 43 may be a variety of shapes depending on the shape of the channel's perimeter and inner conical plateau 24 located above it. For example, the flex portion 45 may be shaped like the keystone-shaped flex portion shown in FIGS. 1A and 2A. A chamfered surface 44 of the center flap portion 40 may be provided. The chamfered surface 44 may slope upwardly from the bottom surface 43 at an angle until it reaches the inner conical plateau 24 above it.

Figure 2:
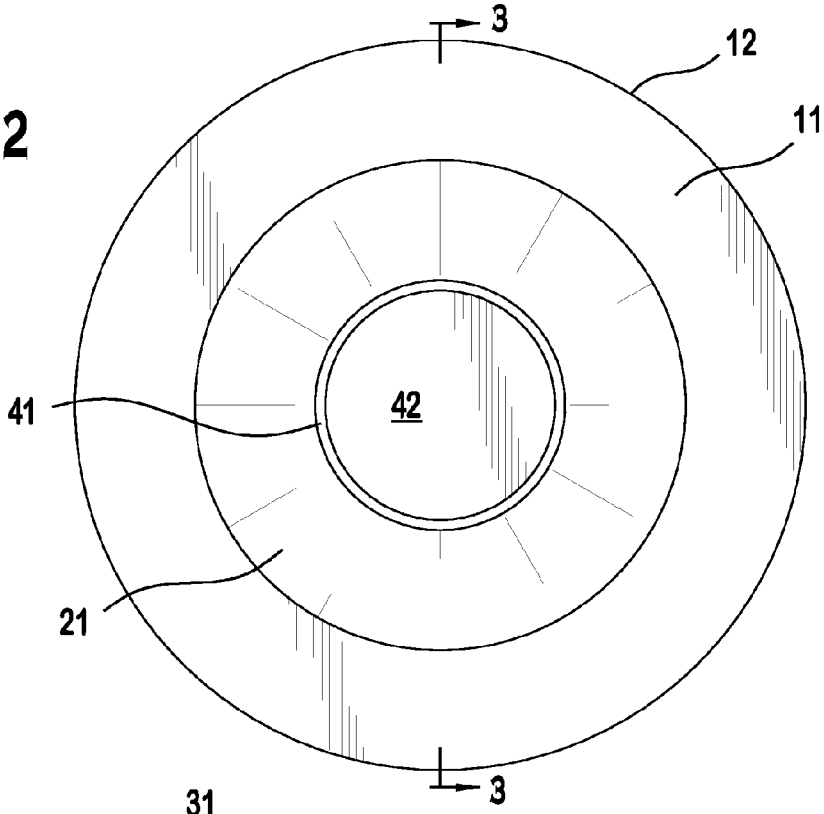
FIG. 2 is a top view of the vial cap.
Figure 2A:
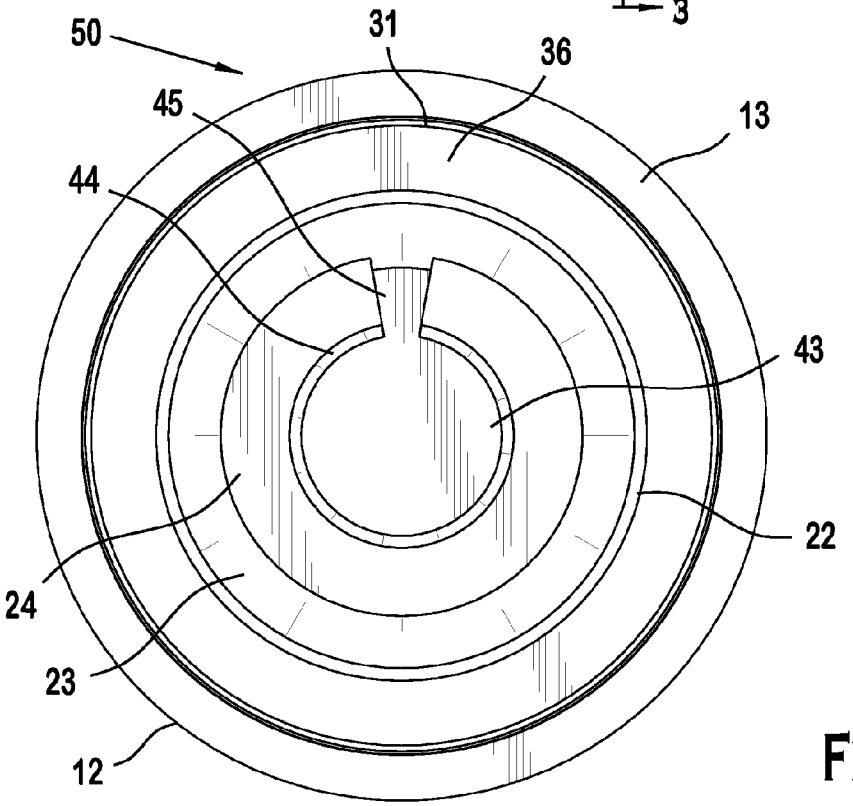
FIG. 2A is a bottom view of the vial cap.
Figure 3:
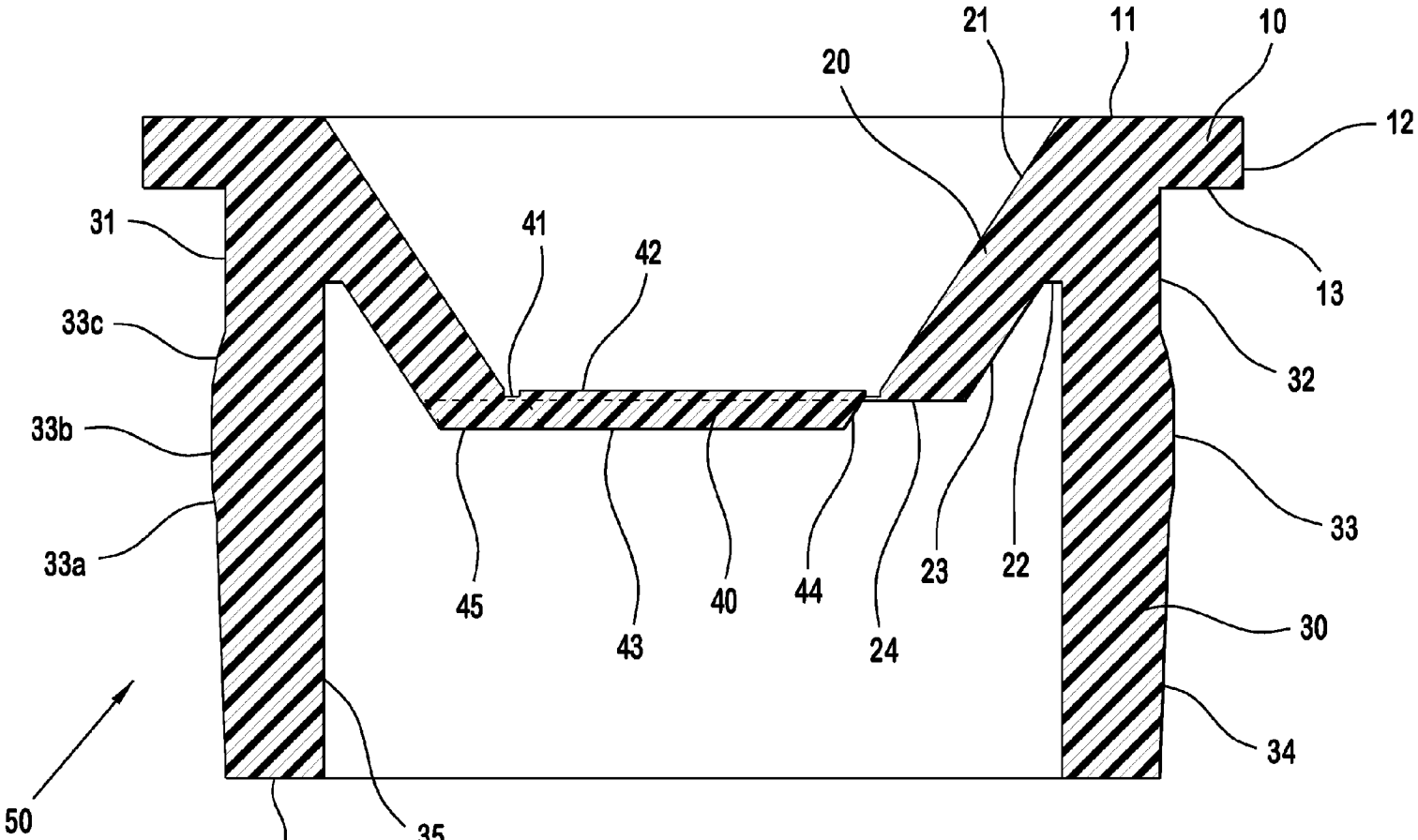
FIG. 3 is a cross-sectional view of the vial cap of FIG. 1.

The top surface 42 of the center flap portion, located below the top surface 11 of the flange, may be circumscribed by the channel 41, for example, as shown in FIGS. 1, 2, and 3. The channel 41 may, for example, be circular, elliptical, or polygonal at its perimeter. A cross-section of the channel 41 may be u-shaped, v-shaped, or other shape that facilitates tearing away from the truncated cone. The cross-section dimensions of the channel 41 may be measured in fractions of millimeters, and the inner conical plateau 24 may be located fractions of millimeters below the bottom of the channel 41. The difference in depth between the channel 41 and the inner conical plateau 24 below it serves to reduce the thickness of the center flap portion 40 along the perimeter of the channel 41, for example, as shown in FIG. 3, so that the pipette can easily push the center flap portion 40 out-and-away from the truncated cone 20.

Figure 4:
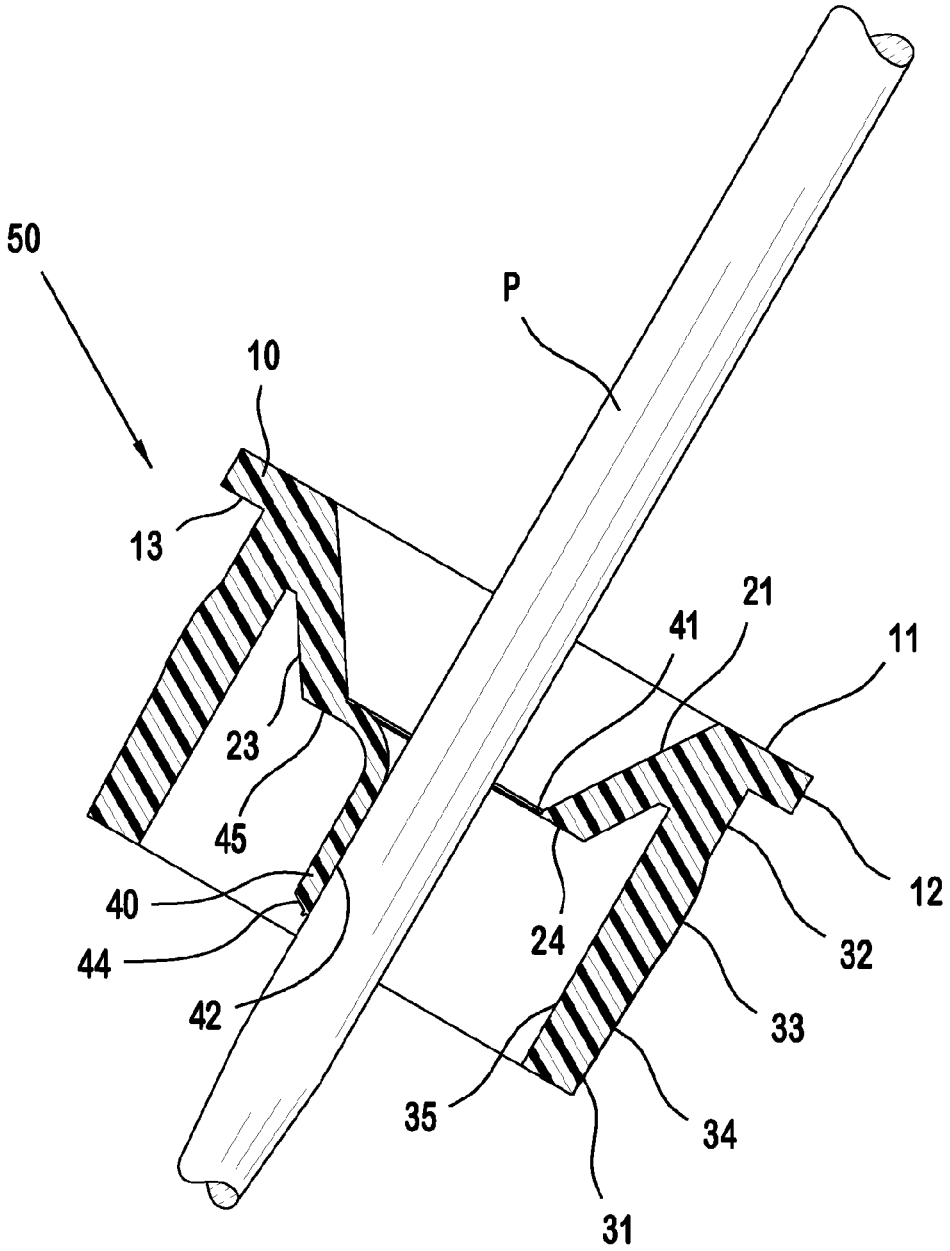
FIG. 4 is a cross-sectional view of an exemplary vial cap and inserted pipette.

Above the flex portion 45, however, the channel 41 acts like a hinge instead of a tear-away feature. The vial cap material below the channel 41 at the flex portion 45 is thicker compared to the thickness of material below the rest of the channel perimeter, allowing the flex portion 45 to resist tearing compared to the remainder of the channel 41. The channel 41 above the flex portion 45 may act like a hinge so that a force exerted by a pipette tears the center flap portion 40 away from the truncated cone, for example, along the rest of the channel perimeter. Thus, the torn away center flap portion 40 flexes downward from the hinge-like channel 41 above the flex portion 45 due to the force exerted by the pipette, but center flap portion 40 does not become dislodged and fall into the vial container. FIG. 4 of the drawings shows the flex portion 45 in a cross-sectional view of the vial cap 50 with inserted pipette P. The diameter of the center flap portion 40 may be, for example, 50% larger than the diameter of the inserted pipette P used with such vial containers. Consequently, the vial containers do not experience significant problems relating to back-pressure or vacuum conditions during the pipetting operation.

Figures 5, 5A, 5B, 5C, 5D, 5E:
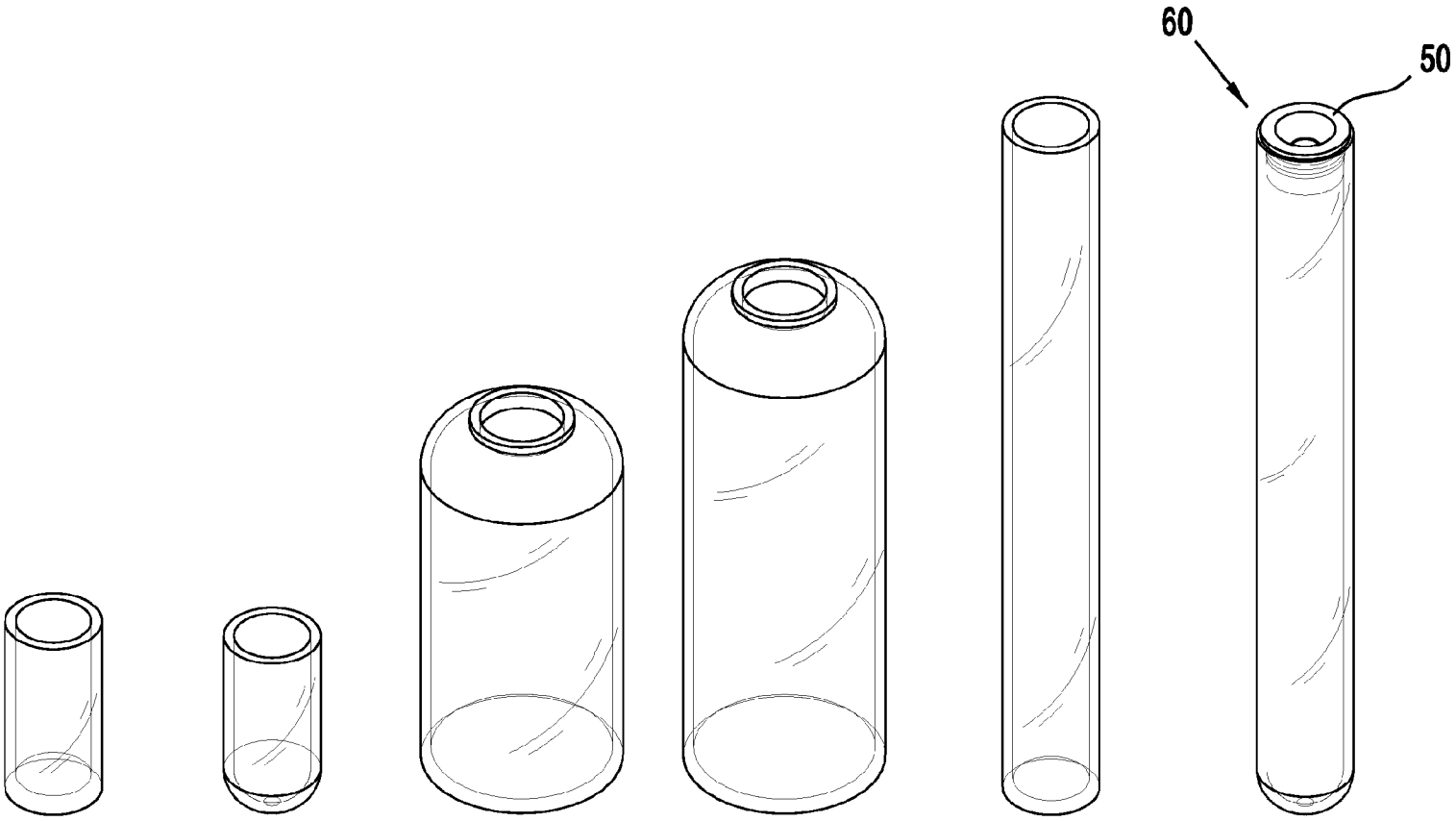
FIG. 5 is a top perspective view of 2 ml flat bottom vial container.
FIG. 5A is a top perspective view of 2 ml rounded bottom vial container.
FIG. 5B is a top perspective view of 1 dram vial container.
FIG. 5C is a top perspective view of 2 dram vial container.
FIG. 5D is a top perspective view of 12 mm×100 mm flat bottom vial container.
FIG. 5E is a top perspective view of 12 mm×100 mm rounded bottom vial container and an engaged exemplary vial cap.

FIGS. 5-5E show some of the assortment of vial containers to which the vial cap can be engaged. The vial containers range in volume and shape, but the drawings show them having the same size openings. FIG. 5E further shows the vial cap 50 engaged with the vial container. It is envisioned that a plurality of vial caps engaged to vial containers may be handled by robotic manipulating arms and/or receive robotic operated pipettes that penetrate the center flap portions.

A combination of the vial cap 50 with the vial container e.g., like the one in FIG. 5E, provides a sealed vessel assembly 60 that may be partially or completely filled with a fluid, or completely evacuated to create a vacuum. The vessel assembly 60 maintains its initial pressure condition until such time that it is penetrated in a pipetting operation as previously described.

Figure 7:
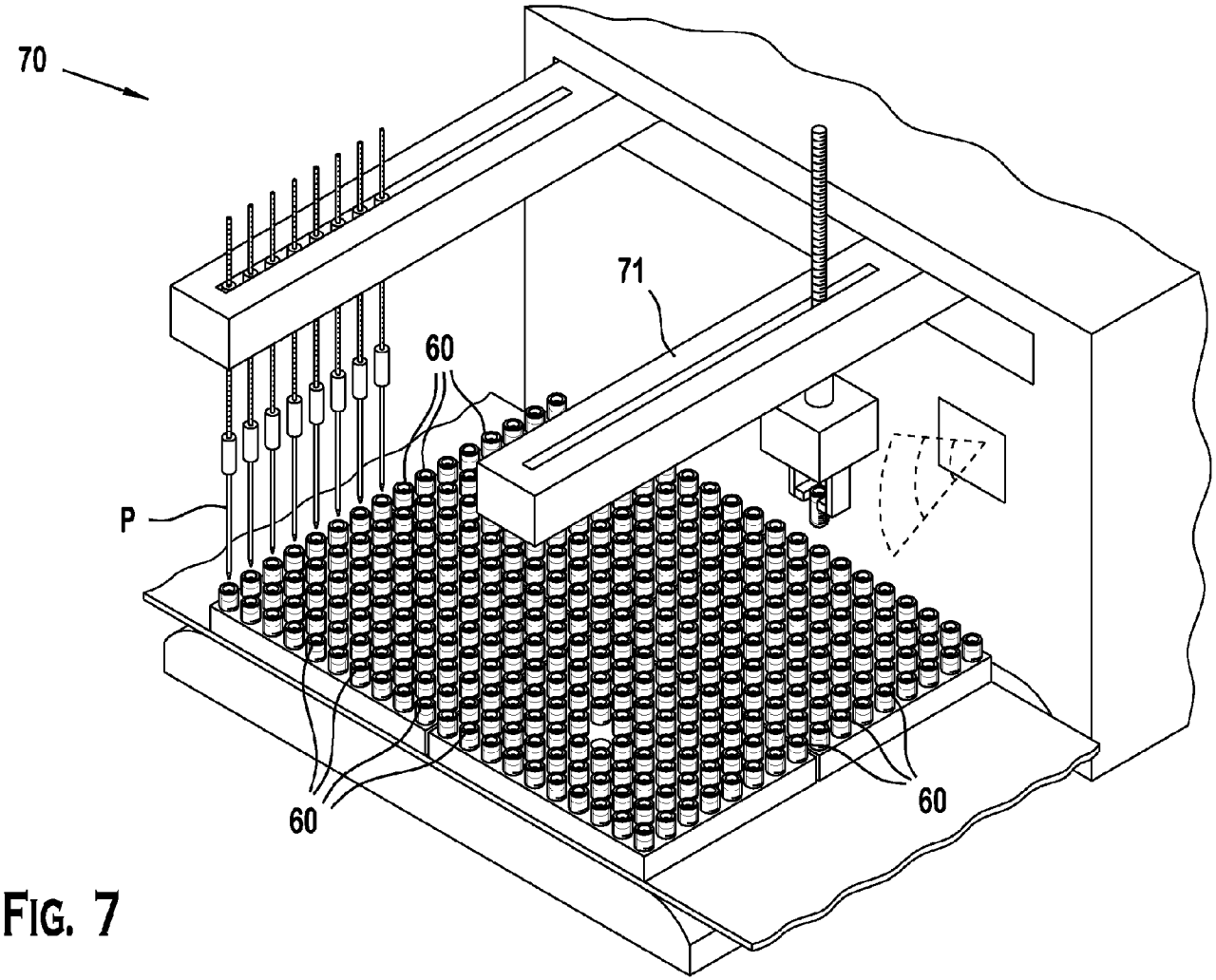
FIG. 7 is a side elevation view of a fluid transfer system.

A fluid transfer system 70 including the vessel assembly 60 (i.e., the vial cap 50 and vial container), and pipette P of the present invention, for example as shown in FIG. 7, is also contemplated. The fluid transfer system 70 may be used for transferring fluid from the vial container to the pipette P or vice versa with precision, and without creating back-pressure and vacuum issues that may arise during filling and removal of fluid. The fluid transfer system 70 may also comprise a robotic manipulating arm 71 for moving the vessel assembly 60 into the proper position for penetration by the pipette P.

The vial cap 50 may be made of an elastomeric material including polypropylene, polystyrene, polyamide, polyethylene, Alathon M5040™, or other suitable polymers. Alathon M5040™ is a high-density polyethylene preferred for its resiliency and resistance to contamination. The Alathon M5040™ vial cap may be injection molded to make the vial cap 50 a monolithic part that can be easily mass-produced.

In one embodiment of the present invention, the overall length of the vial cap 50 from the top surface 11 of the flange 10 to the bottom surface 36 of the tubular seal 30 is about 7.00 mm. The outer periphery of the flange portion 10 is about 11.65 mm, while the sloping outer conical wall surface 21 of the truncated cone 20 has an outer diameter of about 7.85 mm and an inner diameter of about 4.00 mm. The slope of the outer conical wall surface 21 declines about 48.4° from the top surface 11 of the flange 10 to the channel 41 disposed at the top surface 42 of the center flap portion 40.

The top surface 42 of the center flap portion 40 is about 2.90 mm below the top surface 11 of the flange, while the bottom surface 43 of the center flap portion 40 is located about 3.30 mm below the top surface 11 of the flange. The circular channel 41 disposed at the top surface 42 is u-shaped in cross-section having a depth of 0.10 mm and width of 0.15 mm. The inner conical plateau 24 has a depth about 3.00 mm below the top surface 11 of the flange, slightly below that of the bottom of the channel 41 so that most of the channel perimeter 41 has a reduced thickness below it. The center flap portion 40 has the reduced thickness along about 94% of the channel perimeter 41.

The center flap portion 40 connects with the truncated cone 20 and indirectly with the flange 10 and tubular seal portion 30. The inner surface 35 of the tubular seal 30 has an inner diameter of about 7.85 mm and the outer diameter of the tapered portion 34 of the outer wall surface 31 of the tubular seal 30 is about 9.90 mm at the bottom surface 36. Thus, the thickness of the tubular seal 30 is about 2.05 mm at the bottom surface 36.

The outer wall surface 31 of the tubular seal 30 has distinct areas beginning at the tapered portion 34 and progressing to the band portion 33 and the cylindrical portion 32. The band portion 33 is about 2.00 mm long and disposed about 2.80 mm from the bottom surface 36, and may extend about 0.30 mm wider than the outer diameter of the tapered portion 34 at the bottom surface 36. The other end of the band portion 33 terminates at the cylindrical portion 32, which is 1.50 mm long and extends to the bottom surface 13 of the flange 10.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What I claimed is:

1. A vial cap comprising:

a flange portion;

a truncated cone portion;

a tubular seal portion connected to the flange portion and the truncated cone portion, and configured to encircle the truncated cone portion; and a center flap portion connected to the truncated cone portion, the center flap portion being circumscribed by a channel at a top surface and having a flex portion and a tear-away portion below the channel, wherein a thickness of the flex portion extending from an upper surface to a lower surface of the flex portion is greater than a thickness of the tear-away portion extending from an upper surface to a lower surface of the tear-away portion.

2. The vial cap of claim 1, wherein the flange portion is annular and extends to an outer periphery of the vial cap, and wherein a bottom surface of the flange portion extends beyond an outer diameter surface of the tubular seal portion adjacent to the flange portion.

3. The vial cap of claim 1, wherein the tubular seal portion is cylindrically shaped having an inner diameter surface and an outer diameter surface.

4. The vial cap of claim 3, wherein the outer diameter surface of the tubular seal portion has portions with differing slopes and includes a tapered portion, a band portion or a plurality of band portions, and a cylindrical portion.

5. The vial cap of claim 4, wherein the tapered portion slopes from a bottom surface of the tubular seal portion in a direction away from a centerline of the vial cap.

6. The vial cap of claim 4, wherein:

the band portion includes an insertion segment, a flat segment, and an exit segment, the insertion segment increasing in slope over the tapered portion thereby widening the band portion, and decreasing in slope to match the flat segment;

wherein the flat segment has no change in slope and represents the widest part of the outer diameter surface of the tubular seal portion from a centerline of the vial cap; and wherein the exit segment has an initial slope equal to the flat segment of the band portion and decreases in slope until the exit segment terminates at the cylindrical portion.

7. The vial cap of claim 1, wherein the truncated cone portion has an inner conical wall surface that is substantially parallel to the outer conical wall surface, and the inner conical wall surface extends, from an inner conical base formed between the inner conical wall surface and an inner diameter surface of the tubular seal, to an inner conical plateau representing an apex of the cone portion.

8. The vial cap of claim 1, wherein the channel has a cross-sectional shape, including a u-shape or a v-shape, that facilitates the tearing away of the center flap portion from the truncated cone by separating the center flap portion from the truncated cone at the tear-away portion.

9. The vial cap of claim 7, wherein the flex portion extends from the inner conical wall surface to a bottom surface of the center flap portion and toward the center flap portion, and is bordered by ends of the inner conical plateau.

10. The vial cap of claim 9, wherein a chamfered wall surface extends from the bottom surface of the center flap portion at an angle away from a centerline of the vial cap and toward the inner conical plateau.

11. The vial cap of claim 10, wherein the center flap portion is separable from the truncated cone portion by application of a force exerted by a pipette causing the channel nearest the inner conical plateau to tear-away from the truncated cone at the tear away portion, and the channel above the flex portion to act as a hinge for the flex portion so that the center flap portion may bend downward and remain attached to the vial cap.

12. A vessel assembly comprising:

a vial container in contact with a vial cap, the vial cap as claimed in claim 1, wherein the vial container and vial cap are capable of maintaining a sealed pressure condition before execution of a pipetting operation.

13. A fluid transfer system comprising:

a vessel assembly, wherein the vessel assembly includes a vial container in contact with a vial cap, the vial cap including:

a flange portion;

a truncated cone portion;

a tubular seal portion connected to the flange portion and the truncated cone portion, and configured to encircle the truncated cone portion; and a center flap portion connected to the truncated cone portion, the center flap portion being circumscribed by a channel at a top surface and having a flex portion and a tear-away portion, wherein a thickness of the flexible portion extending from an upper surface to a lower surface of the flexible portion is greater than a thickness of the tear-away portion extending from an upper surface to a lower surface of the tear-away portion;

a robotic manipulating arm adapted to grasp the vessel assembly and to move the vessel assembly to and from a fluid transfer position; and a pipette adapted to transfer fluids to and from the vessel assembly after penetration by the pipette at the fluid transfer position.

14. The vial cap of claim 1, wherein the center flap portion includes a bottom surface substantially parallel to the top surface.

15. The vial cap of claim 1, wherein a thickness of material below the channel is less than a thickness of the center flap portion.

16. The vial cap of claim 1, wherein the channel is an indentation in the top surface.

* * * * *